US012127613B2

(12) United States Patent
Browder et al.

(10) Patent No.: US 12,127,613 B2
(45) Date of Patent: Oct. 29, 2024

(54) FOOTBALL GLOVE

(71) Applicant: ENI-JR286, Inc., Torrance, CA (US)

(72) Inventors: Andrew Stephen Browder, Manhattan Beach, CA (US); Cody John Dill, Torrance, CA (US)

(73) Assignee: ENI-JR286, Inc., Torrance, CA (US)

( * ) Notice: Subject to any disclaimer, the term of this patent is extended or adjusted under 35 U.S.C. 154(b) by 31 days.

(21) Appl. No.: 18/129,652

(22) Filed: Mar. 31, 2023

(65) Prior Publication Data

US 2024/0324707 A1 Oct. 3, 2024

(51) Int. Cl.
*A41D 19/015* (2006.01)

(52) U.S. Cl.
CPC ..... *A41D 19/01558* (2013.01)

(58) Field of Classification Search
CPC .. A41D 19/01558; A61B 42/00; A63B 31/02; A63B 71/14
See application file for complete search history.

(56) References Cited

U.S. PATENT DOCUMENTS 4,507,807 A * 4/1985 Karkanen ..... A41D 19/0055 2/21
4,942,626 A * 7/1990 Stern ..... A61B 42/00 2/21
5,173,966 A * 12/1992 DeLeo ..... A41D 19/0062 2/168
5,187,815 A * 2/1993 Stern ..... A61B 42/00 2/167
5,421,033 A * 6/1995 DeLeo ..... A41D 19/0062 2/161.7
6,065,155 A * 5/2000 Sandusky ..... A41D 19/01576 2/161.3
RE36,778 E * 7/2000 DeLeo ..... A41D 19/0062 2/161.7
2006/0185058 A1 8/2006 McGough
2007/0209097 A1 9/2007 Iacullo
2008/0229477 A1 9/2008 McGough
2015/0272242 A1* 10/2015 Bevier ..... A63B 71/141 2/161.1
2016/0213075 A1* 7/2016 Omer ..... A41D 19/01505
2017/0238632 A1* 8/2017 Aprile ..... A63B 71/143
2020/0037683 A1* 2/2020 Ramirez ..... A41D 19/01547
2020/0281291 A1* 9/2020 Balcarczyk ..... A41D 19/00
2020/0397075 A1* 12/2020 Iacono ..... A41D 19/01523
2021/0219637 A1* 7/2021 Iacono ..... A41D 19/015
2023/0371627 A1* 11/2023 Jones ..... A41D 19/00

OTHER PUBLICATIONS

NXTRND, "NXTGRIP, " retrieved from Nxtrnd webpage prior to filing of pending application, (website unknown), Sep. 22, 2022, 1 page.

* cited by examiner

*Primary Examiner* — Jillian K Pierorazio
(74) *Attorney, Agent, or Firm* — Davis Wright Tremaine LLP; George C. Rondeau, Jr.

(57) ABSTRACT

A football glove having a silicone palm portion, silicone finger portions that wrap around lateral side portions to the thumb, index finger and little finger, and a silicone back portion that wraps around a lateral side portion of the back to increase the user's hand grip on a football. The silicone portions and non-silicone portions of the glove are connected together along locations on the back side of the glove so as to on the rear portions of the glove to provide a continuous smooth catching surface for the glove user.

21 Claims, 6 Drawing Sheets

FOOTBALL GLOVE

BACKGROUND OF THE INVENTION

Field of the Invention

The present invention is directed generally to sporting gloves, and more particularly to a glove designed for improving catching and handling a football.

Description of the Related Art

Gloves of various designs have long been used in various sports to improve performance. The various performance-enhancing aspects which these gloves offer include providing a better grip on a baseball bat or golf club, for support, such as in bowling, and for gripping a ball, such as in basketball and football. At least with respect to football gloves, the grip provided by current football gloves is still not as sufficient as desirable.

Therefore, a need exists for a new design of football glove that increases the grip of the user's gloved hand on the football when catching and handling a football. The present application provides such a glove, as will be apparent from the following detailed description and accompanying figures.

BRIEF DESCRIPTION OF THE SEVERAL VIEWS OF THE DRAWING(S)

Like reference numerals have been used in the figures to identify like components.

DETAILED DESCRIPTION OF THE INVENTION

Figure 1:
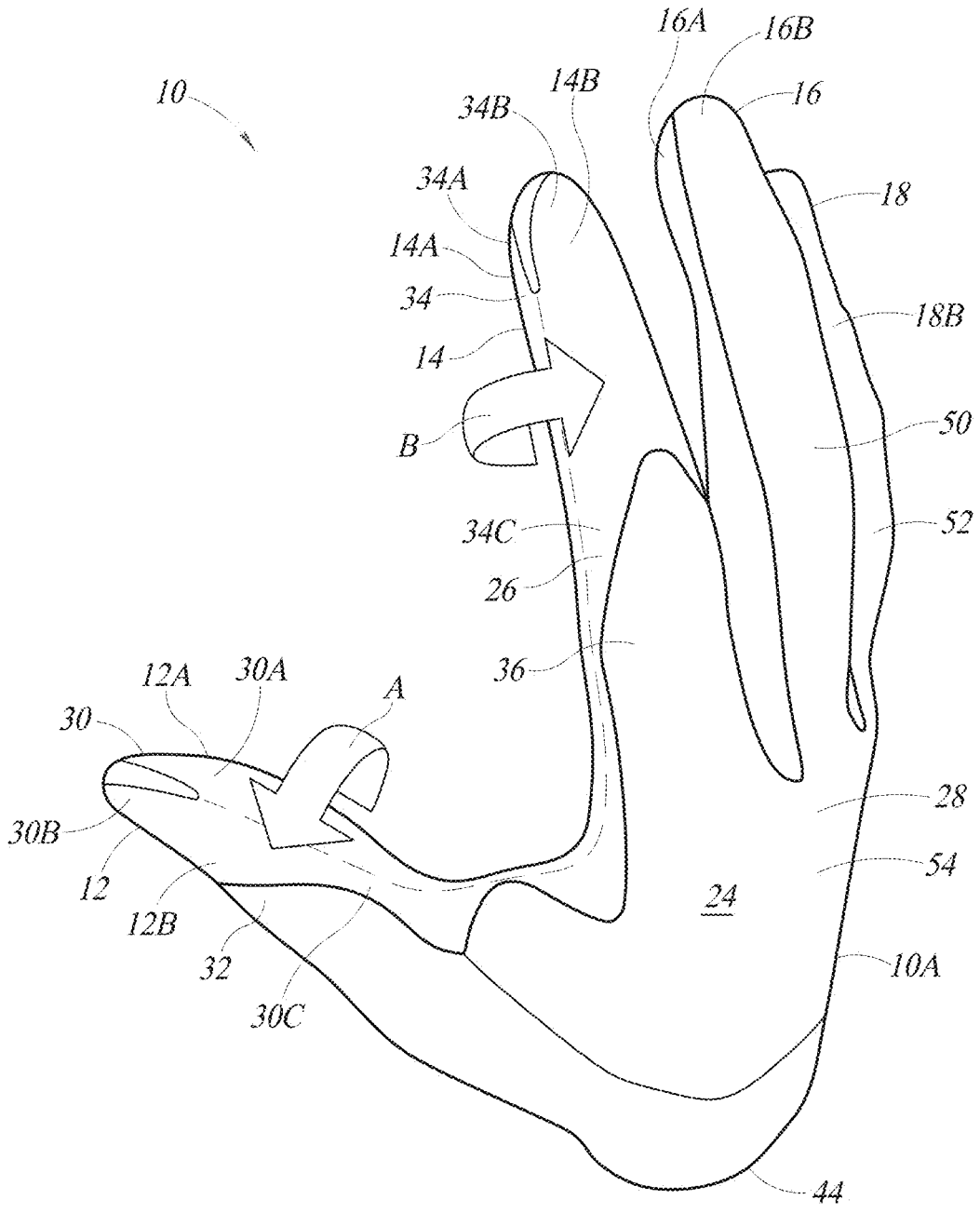
FIG. 1 is a thumb side, back perspective view of a football glove in accordance with an embodiment of the present invention.
Figure 2:
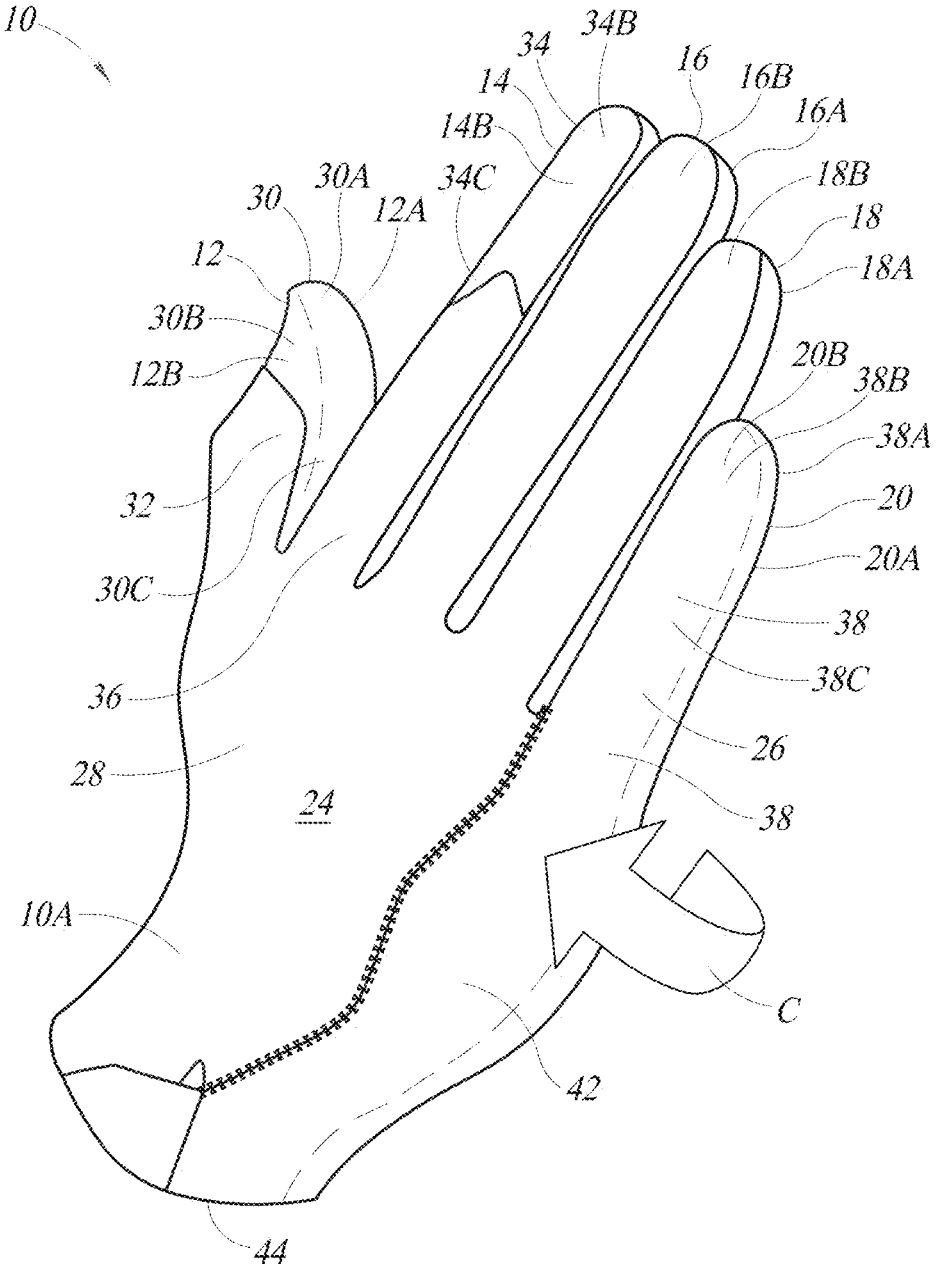
FIG. 2 is a little finger side, back perspective view of the football glove of FIG. 1.

FIGS. 1-6 illustrate a preferred embodiment of a football glove 10. While the illustrated glove is for the right hand and the following description will be for the right-hand glove, it should be understood that the left hand glove is a mirror image thereof and has the same basic construction as described for the right hand glove.

The finished glove 10 includes five fingers, i.e., a thumb 12, an index finger 14, a middle finger 16, a ring finger 18, and a little (pinky) finger 20, and also a front or palm portion 22 and a rear or back portion 24 from which the fingers project outward. Together, the palm portion 22 and the back portion 24 of the glove 10 define a glove main body 10A.

Each of the fingers 12, 14, 16, 18, and 20 has a front portion 12A, 14A, 16A, 18A, and 20A, respectively, that extends over the front of the finger, and a rear portion 12B, 14B, 16B, 18B, and 20B, respectively, that extends over the rear of the finger. The front portion of the fingers is on the same side as the palm portion 22 of the glove and the rear portion of the fingers is on the same side as the back portion 24 of the glove.

Figure 3:
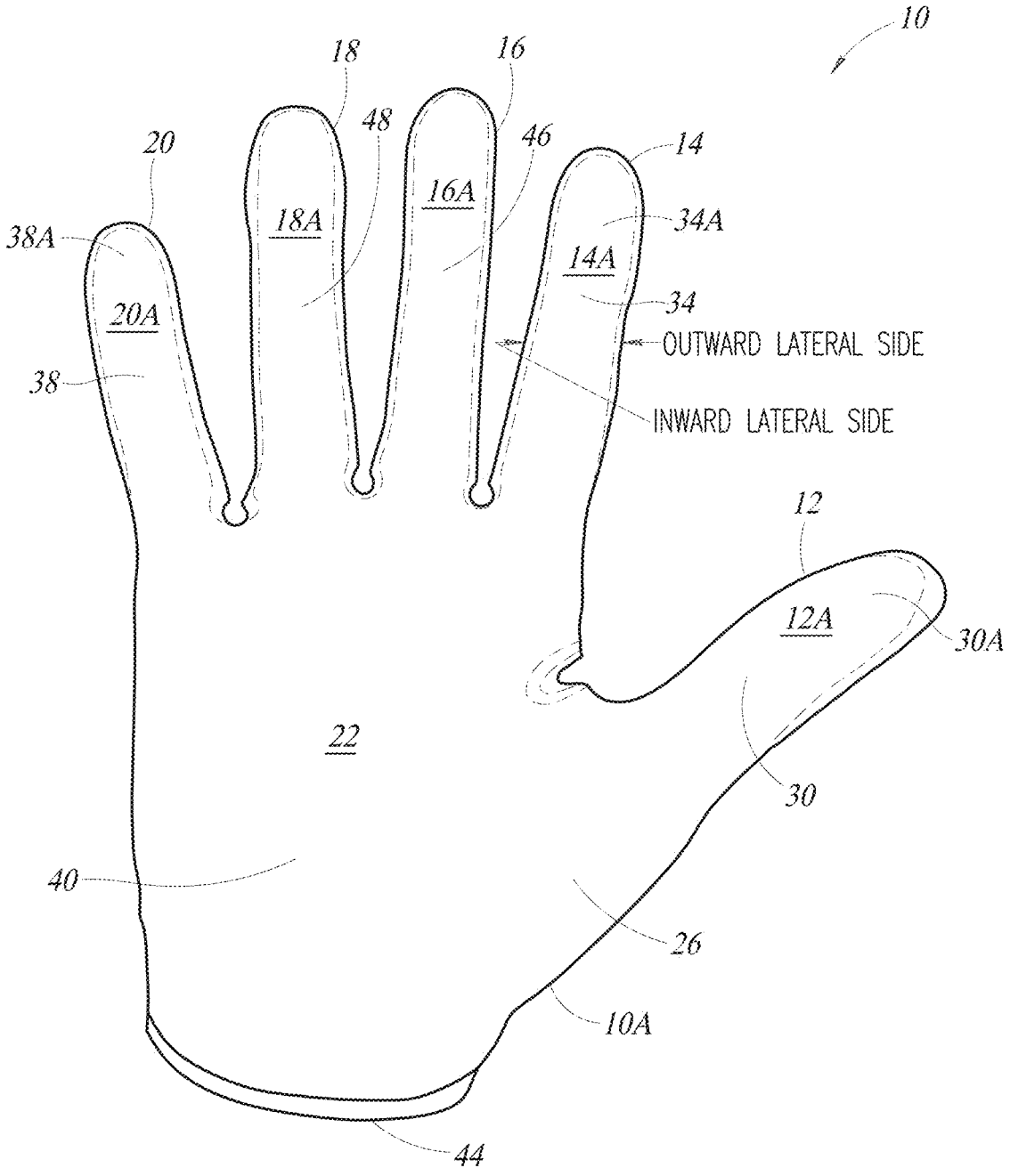
FIG. 3 is a palm view of the football glove of FIG. 1.
Figure 4:
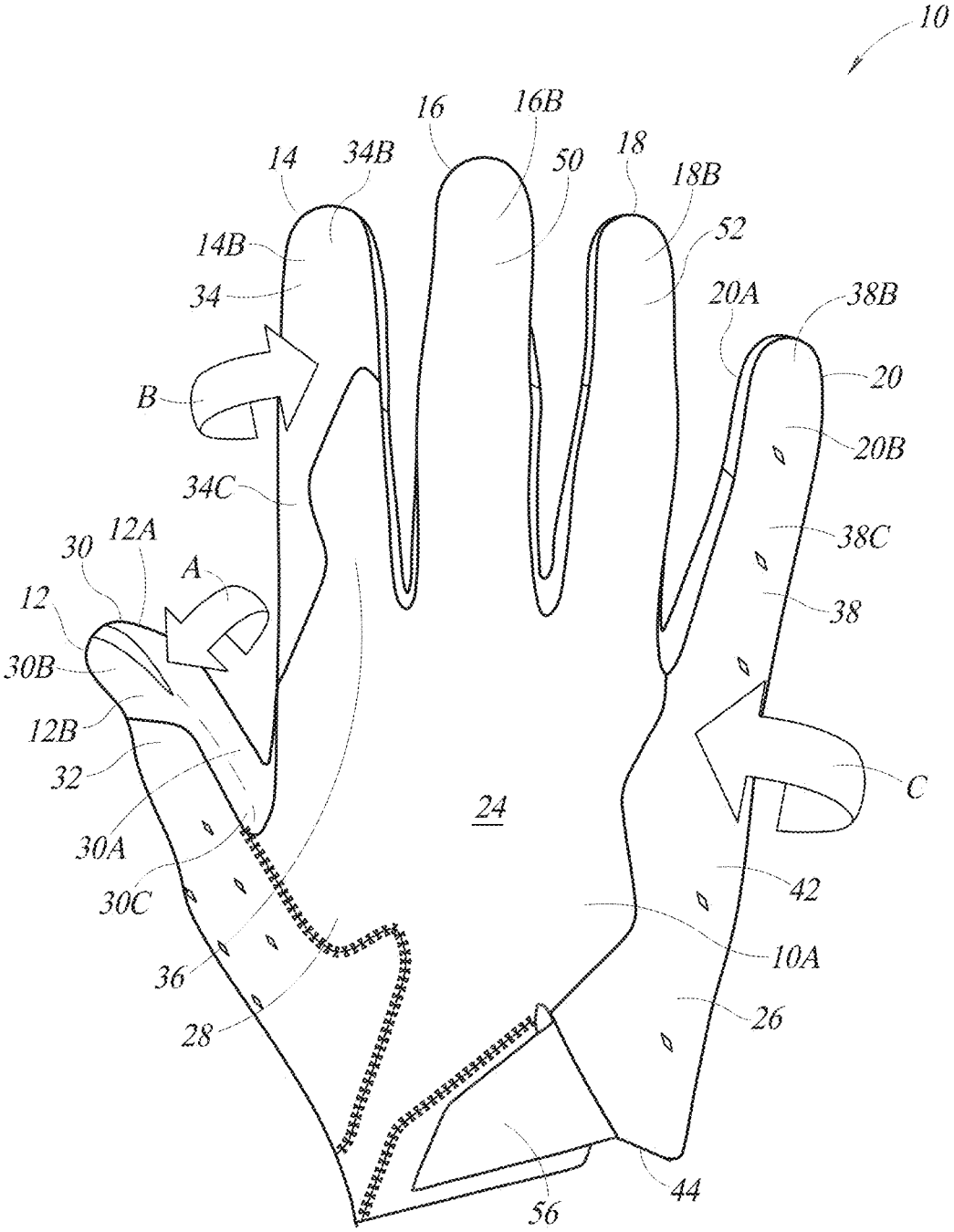
FIG. 4 is a back view of the football glove of FIG. 1.

For purposes of reference and understanding of the invention described herein, the front portion and rear portion of each finger laterally terminates at opposite outward and inward lateral sides of the finger. In other words, as shown in FIG. 3 for the right-hand glove when viewed from the front/palm side of the glove, the outward lateral side of each finger is on the right and the inward lateral side of each is on the left. Of course, this is the reverse when the right-hand glove is viewed from its rear/back side as shown in FIG. 4. Also, for purposes of reference and understanding of the invention described herein, each of the outward and inward lateral sides of the finger are considered as having an imaginary medial line extending along the length of the finger. The front and rear portions of each finger, as used herein, terminate at the outward and inward lateral sides of the finger at the imaginary medial line.

Further, for purposes of reference and understanding of the invention described herein, the glove main body 10A laterally terminates at opposite outward and inward lateral sides of the glove main body. In other words, as shown in FIG. 3 for the right-hand glove when viewed from the front/palm side of the glove, the outward lateral side of the glove main body is on the right and the inward lateral side thereof is on the left. Of course, this is the reverse when the right-hand glove is viewed from its rear/back side as shown in FIG. 4. Also for purposes of reference and understanding of the invention described herein, each of the outward and inward lateral sides of the glove main body 10A are considered as having an imaginary medial line extending along its length, the imaginary medial line of the outward lateral side being generally longitudinally aligned with the imaginary medial line of the outward lateral side of the thumb 12 and the imaginary medial line of the inward lateral side being generally longitudinally aligned with the imaginary medial line of the inward side of the little finger 20. The palm and back portions of the glove main body, as used herein, terminate at the outward and inward lateral sides of the glove main body at the imaginary medial line.

Particular portions of the fingers and other portions of the glove 10 are made from a fabric substrate material with an overlay of a silicone material, with those portions collectively being referred to herein as the silicone glove portion 26, and other portions of the glove are made from a performance knit or woven fabric, or a PU (polyurethane) synthetic material, with those portions collectively being referred to herein as the non-silicone glove portion 28. It is to be understood that the non-silicon glove portion 28 may include a textured outer surface with limited surface portions covered by a silicone material.

With reference to FIGS. 1-4, the silicone glove portion 26 includes a silicone thumb portion 30 comprising a silicone front portion 30A of the front portion 12A of the thumb 12, a silicone rear portion 30B of the rear portion 12B of the thumb located toward the free-end of the thumb, and an elongated silicone rear portion 30C of the rear portion of the thumb extending along the medial line on the inward lateral side of the thumb. The silicone front portion 30A of the front portion 12A of the thumb 12 preferably covers the entire front portion 12A of the thumb. The silicone rear portion 30B of the rear portion 12B of the thumb located toward the free end of the thumb 12 preferably extends laterally outward from the medial line on the inward lateral side of the thumb to at or near the medial line on the outward lateral side of the thumb, thus wrapping around the inward lateral side of the thumb (see arrow "A" indicating the direction of wrapping). The elongated silicone rear portion 30C extends laterally outward from the medial line on the inward lateral side of the thumb, preferably only partially toward the medial line on the outward lateral side of the thumb, thus wrapping around the inward lateral side of the thumb (see arrow "A" indicating the direction of wrapping).

The non-silicone glove portion 28 of the glove 10 includes a non-silicone thumb portion 32 of the thumb 12 located between the silicone front portion 30A, the silicone rear portion 30B, and the elongated silicone rear portion 30C.

The silicon glove portion 26 also includes a silicone index finger portion 34 comprising a silicone front portion 34A of the front portion 14A of the index finger 14, a silicone rear portion 34B of the rear portion 14B of the index finger located toward the free-end of the index finger, and an elongated silicone rear portion 34C of the rear portion of the index finger extending along the medial line on the outward lateral side of the index finger. The silicone front portion 34A of the front portion 14A of the index finger 14 preferably covers the entire front portion 14A of the index finger. The silicone rear portion 34B of the rear portion 14B of the index finger 14 located toward the free end of the index finger 14 preferably extends laterally inward from the medial line on the outward lateral side of the index finger to at or near the medial line on the inward lateral side of the index finger, thus wrapping around the outward lateral side of the index finger (see arrow "B" indicating the direction of wrapping). The elongated silicone rear portion 34C extends laterally inward from the medial line on the outward lateral side of the index finger, preferably only partially toward the medial line on the inward lateral side of the index finger, thus wrapping around the outward lateral side of the index finger (see arrow "B" indicating the direction of wrapping).

The non-silicone portion 28 of the glove 10 also includes a non-silicone index finger portion 36 of the index finger 14 located between the silicone front portion 34A, the silicone rear portion 34B, and the elongated silicone rear portion 34C.

The silicone glove portion 26 also includes a silicone little finger portion 38 comprising a silicone front portion 38A of the front portion 20A of the little finger 20, a silicone rear portion 38B of the rear portion 20B of the little finger located toward the free-end of the little finger, and an elongated silicone rear portion 38C of the rear portion of the little finger extending along the medial lines on the outward and inward lateral sides of the little finger. The silicone front portion 38A of the front portion 20A of the little finger 20 preferably covers the entire front portion 20A of the little finger. The silicone rear portion 38B of the rear portion 20B of the little finger located toward the free end of the little finger 20 preferably extends laterally outward from the medial line on the inward lateral side of the little finger to at or near the medial line on the outward lateral side of the little finger, thus wrapping around the inward lateral side of the little finger (see arrow "C" indicating the direction of wrapping). The elongated silicone rear portion 38C preferably extends laterally outward from the medial line on the inward lateral side of the little finger to at or near the medial line on the outward lateral side of the little finger, thus wrapping around the inward lateral side of the little finger (see arrow "C" indicating the direction of wrapping).

The silicone glove portion 26 also includes a silicone palm portion 40, preferably comprising the entire palm portion 22, and an elongated silicone rear portion 42 of the back portion 24 extending along the medial line on the inward lateral side of the glove main body 10A, preferably between the elongated silicone rear portion 38C of the rear portion 20B of the little finger 20 and an open end portion 44 of the glove 10 into which a user insert the user's hand. The elongated silicone rear portion 42 of the back portion 24 extends laterally outward from the medial line on the inward lateral side of the glove main body 10A, preferably only partially toward the medial line on the outward lateral side of the glove main body, to about a position below the rear portion 18B of the ring finger 18, thus wrapping around the inward lateral side of the glove main body.

The silicone glove portion 26 also includes a silicone middle finger portion 46, preferably comprising the entire front portion 16A of the middle finger 16, and a silicone ring finger portion 48, preferably comprising the entire front portion 18A of the ring finger 18.

The non-silicone portion 28 of the glove 10 also includes a non-silicone middle finger portion 50 comprising the rear portion 16B of the middle finger 16, and a non-silicone ring finger portion 52 comprising the rear portion 18B of the ring finger 18. The non-silicone portion 28 of the glove 10 also includes a non-silicone back portion 54 comprising the portion of the back portion 24 not included in the silicone glove portion 26 described above.

Figure 5:
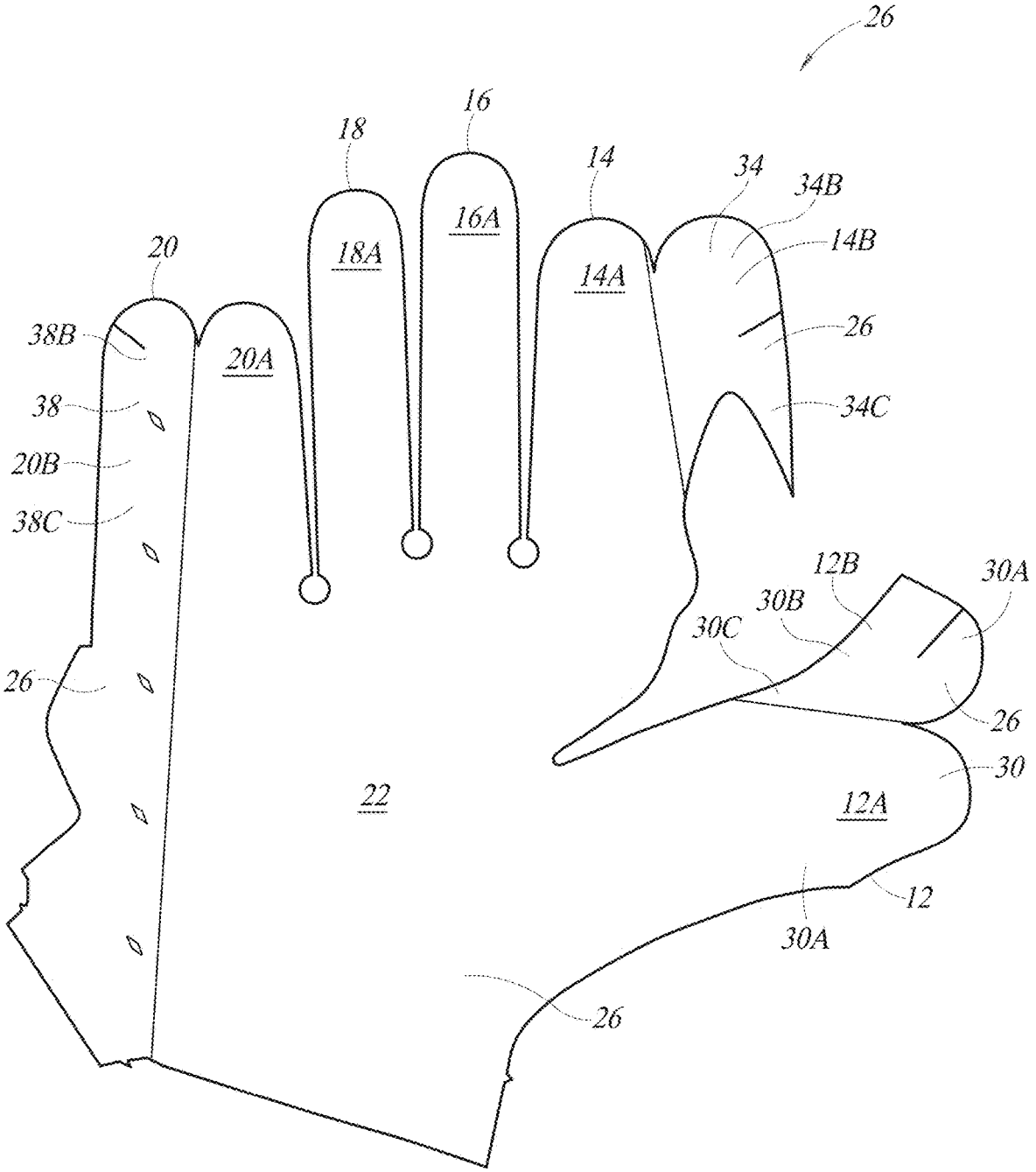
FIG. 5 is a top plan view of a flat construction pattern of a silicon glove portion used to form the football glove of FIG. 1.
Figure 6:
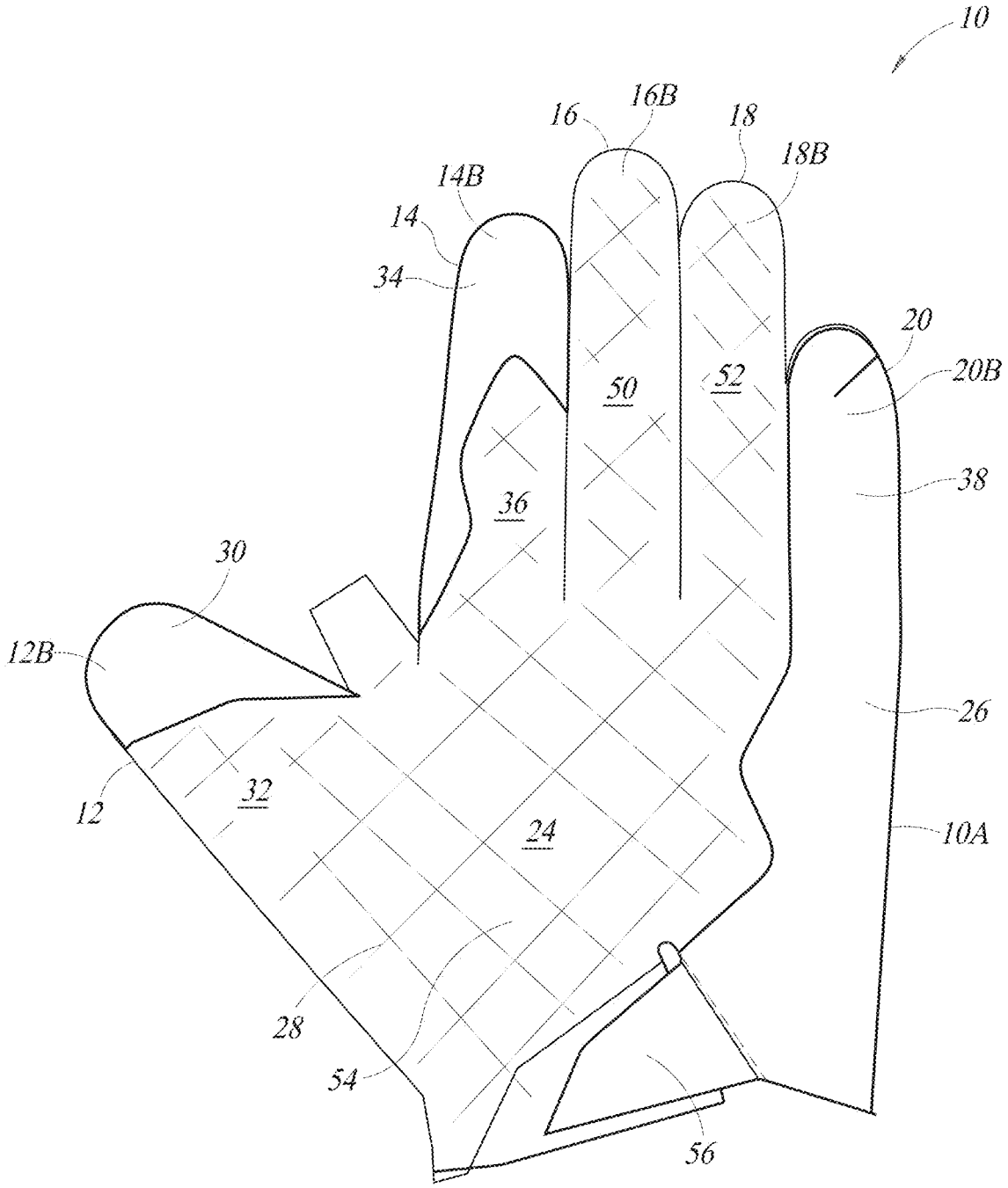
FIG. 6 is a back view of the football glove of FIG. 1 showing the silicon glove portion and non-silicone glove portion after the silicone edge portions have been wrapped around to the back portion of the glove.

FIG. 5 shows a flat construction pattern of the silicon glove portion 26 used to form the glove 10 described above for the right hand, and corresponds to the front/palm view shown in FIG. 3, except that it shows (a) the silicone rear portion 30B and elongated silicone reach portion 30C before being wrapped around the inward lateral side of the thumb, (b) the silicone rear portion 34B and the elongated silicone rear portion 34C before being wrapped around the outward lateral side of the index finger, and (c) the silicone rear portion 38B and the elongated silicone rear portion 38C before being wrapped around the inward lateral side of the little finger. FIG. 6 shows rear/back side view of the glove 10, much as shown in FIG. 3, after these silicon portions have been wrapped around the around the inward lateral side of the thumb, the outward lateral side of the index finger, and the inward lateral side of the little finger. The non-silicon glove portion 28 is shown cross-hatched to distinguish from the silicone glove portion 26. The construction pattern uses the same reference numbers as used for the features of the finished glove.

The edge portions of the silicon glove portion 26 and the non-silicone glove portion 28 may be connected together using stitching or by fusing them together or another suitable non-stitching method. The connections of the silicon glove portion 26 and the non-silicone glove portion 28 occur along locations on the back side of the glove rather than on the palm side of the glove, with the connection of the silicone rear portion 30B and elongated silicone rear portion 30C to the non-silicone glove portion being spaced away from the medial line on the inward lateral side of the thumb 12, with the connection of the silicone rear portion 34B and the elongated silicone rear portion 34C to the non-silicone glove portion being spaced away from the medial line on the outward lateral side of the index finger 14, and with the connection of the silicone rear portion 38B and the elongated silicone rear portion 38C to the non-silicone glove portion being spaced away from the medial line on the inward lateral side of the little finger 20 and the inward lateral side of the little finger. With this arrangement, the area of silicone glove portion 26 and hence silicon material to contact a football when being caught or otherwise handled is increased beyond the area of the silicone palm portion 40 (and the contact friction with the football), thus increasing the user's hand grip on the football and the chance of catching and securely holding the football. Further, the connections of the silicon grove portion 26 to the non-silicone glove portion 28 occur on the back portion 24 of the glove 10, thus providing a continuous smooth catching surface and thereby avoiding the hinderance and distraction cause by seams located in the catching surface (particularly along the side seams on the inward side of the thumb, the outward side of the index finger and the inward side of the little finger). The wrapped construction described allows for a zero distraction feel, as well as reduces construction costs and the possibility of tearing.

The glove 10 includes a strap 56 at the open-end portion 44 of the glove to adjust the glove around the wrist of the user. The strap 56 is adjustably secured using a hook-and-loop fastener. Generally, the glove is sized to fit snuggly around the hand of the user.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A glove comprising:

a thumb;

an index finger;

a middle finger;

a ring finger;

a little finger, each finger having a front portion extending over the front of the finger and a rear portion extending over the rear of the finger, each finger having an outward lateral side with an imaginary medial line extending along the length of the finger and an inward lateral side with an imaginary medial line extending along the length of the finger;

a palm portion;

a back portion, together the palm portion and the back portion define a glove main body, the glove main body having an outward lateral side with an imaginary medial line extending along the length of the outward lateral side of the glove main body and an inward lateral side with an imaginary medial line extending along the length of the inward lateral side of the glove main body, the fingers projecting outward from the palm and back portions, the front portion of each of the fingers being on the same side as the palm portion, and the rear portion of each of the fingers being on the same side as the back portion;

the glove having a silicone glove portion at least partially made from a silicone material and a non-silicone glove portion made from a non-silicone material, the silicone glove portion having:

a silicone thumb portion comprising:

a silicone front portion of the front portion of the thumb, a silicone rear portion of the rear portion of the thumb located toward a free end of the thumb and extending laterally outward from the medial line on the inward lateral side of the thumb to at or near the medial line on the outward lateral side of the thumb so as to wrap around the inward lateral side of the thumb, and an elongated silicone rear portion of the rear portion of the thumb extending along the medial line on the inward lateral side of the thumb, the elongated silicone rear portion of the rear portion of the thumb extending laterally outward from the medial line on the inward lateral side of the thumb only partially toward the medial line on the outward lateral side of the thumb but sufficiently so as to wrap around the inward lateral side of the thumb;

a silicone index finger portion comprising:

a silicone front portion of the front portion of the index finger, a silicone rear portion of the rear portion of the index finger located toward a free end of the index finger and extending laterally inward from the medial line on the outward lateral side of the index finger to at or near the medial line on the inward lateral side of the index finger so as to wrap around the outward lateral side of the index finger, and an elongated silicone rear portion of the rear portion of the index finger extending along the medial line on the outward lateral side of the index finger, the elongated silicone rear portion of the rear portion of the index finger extending laterally inward from the medial line on the outward lateral side of the index finger only partially toward the medial line on the inward lateral side of the index finger but sufficiently so as to wrap around the outward lateral side of the index finger;

a silicone little finger portion comprising:

a silicone front portion of the front portion of the little finger, a silicone rear portion of the rear portion of the little finger located toward a free end of the little finger and extending laterally outward from the medial line on the inward lateral side of the little finger to at or near the medial line on the outward lateral side of the little finger so as to wrap around the inward lateral side of the little finger, and an elongated silicone rear portion of the rear portion of the little finger extending along the medial lines on the outward and inward lateral sides of the little finger, the elongated silicone rear portion of the rear portion of the little finger extending laterally outward from the medial line on the inward lateral side of the little finger to at or near the medial line on the outward lateral side of the little finger so as to wrap around the inward lateral side of the little finger;

a silicone palm portion; and an elongated silicone rear portion of the back portion extending along the medial line on the inward lateral side of the glove main body between the elongated silicone rear portion of the rear portion of the little finger and to or near an open end portion of the glove, the elongated silicone rear portion of the back portion extending laterally outward from the medial line on the inward lateral side of the glove main body only partially toward the medial line on the outward lateral side of the glove main body, to or near a position below the rear portion of the ring finger so as to wrap around the inward lateral side of the glove main body.

2. The glove of claim 1, wherein the silicone glove portion further includes a silicone middle finger portion comprising the front portion of the middle finger and a silicone ring finger portion comprising the front portion of the ring finger.

3. The glove of claim 1, wherein the non-silicone glove portion comprises a non-silicone thumb portion of the rear portion of the thumb located between the silicone front portion, the silicone rear portion of the rear portion of the thumb, and the elongated silicone rear portion of the rear portion of the thumb, and the non-silicone thumb portion of the rear portion of the thumb is connected to the silicone rear portion of the rear portion of the thumb and to the elongated silicone rear portion of the rear portion of the thumb along locations on the rear portion of the thumb.

4. The glove of claim 3, wherein the locations of the connection on the rear portion of the thumb of the non-silicone thumb portion of the rear portion of the thumb to the silicone rear portion of the rear portion of the thumb and the elongated silicone rear portion of the rear portion of the thumb are spaced away from the medial line on the inward lateral side of the thumb.

5. The glove of claim 1, wherein the non-silicone glove portion comprises a non-silicone index finger portion of the rear portion of the index finger located between the silicone front portion of the front portion of the index finger, the silicone rear portion of the rear portion of the index finger, and the elongated silicone rear portion of the rear portion of the index finger, and the non-silicone index finger portion of the rear portion of the index finger is connected to the silicone rear portion of the rear portion of the index finger and to the elongated silicone rear portion of the rear portion of the index finger along locations on the rear portion of the index finger.

6. The glove of claim 5, wherein the locations of the connection on the rear portion of the index finger of the non-silicone index finger portion of the rear portion of the index finger to the silicone rear portion of the rear portion of the index finger and to the elongated silicone rear portion of the rear portion of the index finger are spaced away from the medial line on the outward lateral side of the index finger.

7. The glove of claim 1, wherein the silicone rear portion of the rear portion of the little finger and the elongated silicone rear portion of the rear portion of the little finger are connected to the non-silicone glove portion along locations on the rear portion of the little finger.

8. The glove of claim 7, wherein the locations of the connection on the rear portion of the little finger of the silicone rear portion of the rear portion of the little finger and the elongated silicone rear portion of the rear portion of the little finger are spaced away from the medial line on the inward lateral side of the little finger.

9. The glove of claim 1, wherein the non-silicone glove portion comprises:

a non-silicone middle finger portion comprising the rear portion of the middle finger, and a non-silicone ring finger portion comprising the rear portion of the ring finger.

10. The glove of claim 9, wherein the non-silicone glove portion further comprises a non-silicone back portion comprising the portion of the back portion not included in the silicone glove portion.

11. A glove comprising:

a thumb;

an index finger;

a middle finger;

a ring finger;

a little finger, each finger having a front portion extending over the front of the finger and a rear portion extending over the rear of the finger, each finger having an outward lateral side with an imaginary medial line extending along the length of the finger and an inward lateral side with an imaginary medial line extending along the length of the finger;

a palm portion;

a back portion, together the palm portion and the back portion define a glove main body, the glove main body having an outward lateral side with an imaginary medial line extending along the length of the outward lateral side of the glove main body and an inward lateral side with an imaginary medial line extending along the length of the inward lateral side of the glove main body, the fingers projecting outward from the palm and back portions, the front portion of each of the fingers being on the same side as the palm portion, and the rear portion of each of the fingers being on the same side as the back portion;

the glove having a silicone glove portion at least partially made from a silicone material and a non-silicone glove portion made from a non-silicone material, the silicone glove portion having:

a silicone thumb portion comprising:

a silicone front portion of the front portion of the thumb, a silicone rear portion of the rear portion of the thumb located toward a free end of the thumb and extending laterally outward from the medial line on the inward lateral side of the thumb toward the medial line on the outward lateral side of the thumb sufficiently to wrap around the inward lateral side of the thumb, and an elongated silicone rear portion of the rear portion of the thumb extending along the medial line on the inward lateral side of the thumb, the elongated silicone rear portion of the rear portion of the thumb extending laterally outward from the medial line on the inward lateral side of the thumb only partially toward the medial line on the outward lateral side of the thumb but sufficiently to wrap around the inward lateral side of the thumb;

a silicone index finger portion comprising:

a silicone front portion of the front portion of the index finger, a silicone rear portion of the rear portion of the index finger located toward a free end of the index finger and extending laterally inward from the medial line on the outward lateral side of the index finger toward the medial line on the inward lateral side of the index finger sufficiently to wrap around the outward lateral side of the index finger, and an elongated silicone rear portion of the rear portion of the index finger extending along the medial line on the outward lateral side of the index finger, the elongated silicone rear portion of the rear portion of the index finger extending laterally inward from the medial line on the outward lateral side of the index finger only partially toward the medial line on the inward lateral side of the index finger but sufficiently to wrap around the outward lateral side of the index finger;

a silicone little finger portion comprising:

a silicone front portion of the front portion of the little finger, a silicone rear portion of the rear portion of the little finger located toward a free end of the little finger and extending laterally outward from the medial line on the inward lateral side of the little finger toward the medial line on the outward lateral side of the little finger sufficiently to wrap around the inward lateral side of the little finger, and an elongated silicone rear portion of the rear portion of the little finger extending along the medial line on the inward lateral side of the little finger, the elongated silicone rear portion of the rear portion of the little finger extending laterally outward from the medial line on the inward lateral side of the little finger toward the medial line on the outward lateral side of the little finger sufficiently to wrap around the inward lateral side of the little finger;

a silicone palm portion; and an elongated silicone rear portion of the back portion extending along the medial line on the inward lateral side of the glove main body between the elongated silicone rear portion of the rear portion of the little finger and toward an open end portion of the glove, the elongated silicone rear portion of the back portion extending laterally outward from the medial line on the inward lateral side of the glove main body only partially toward the medial line on the outward lateral side of the glove main body sufficiently to wrap around the inward lateral side of the glove main body.

12. The glove of claim 11, wherein the silicone glove portion further includes a silicone middle finger portion comprising the front portion of the middle finger and a silicone ring finger portion comprising the front portion of the ring finger.

13. The glove of claim 11, wherein the non-silicone glove portion comprises a non-silicone thumb portion of the rear portion of the thumb located between the silicone front portion, the silicone rear portion of the rear portion of the thumb, and the elongated silicone rear portion of the rear portion of the thumb, and the non-silicone thumb portion of the rear portion of the thumb is connected to the silicone rear portion of the rear portion of the thumb and to the elongated silicone rear portion of the rear portion of the thumb along locations on the rear portion of the thumb.

14. The glove of claim 13, wherein the locations of the connection on the rear portion of the thumb of the non-silicone thumb portion of the rear portion of the thumb to the silicone rear portion of the rear portion of the thumb and the elongated silicone rear portion of the rear portion of the thumb are spaced away from the medial line on the inward lateral side of the thumb.

15. The glove of claim 11, wherein the non-silicone glove portion comprises a non-silicone index finger portion of the rear portion of the index finger located between the silicone front portion of the front portion of the index finger, the silicone rear portion of the rear portion of the index finger, and the elongated silicone rear portion of the rear portion of the index finger, and the non-silicone index finger portion of the rear portion of the index finger is connected to the silicone rear portion of the rear portion of the index finger and to the elongated silicone rear portion of the rear portion of the index finger along locations on the rear portion of the index finger.

16. The glove of claim 15, wherein the locations of the connection on the rear portion of the index finger of the non-silicone index finger portion of the rear portion of the index finger to the silicone rear portion of the rear portion of the index finger and to the elongated silicone rear portion of the rear portion of the index finger are spaced away from the medial line on the outward lateral side of the index finger.

17. The glove of claim 11, wherein the silicone rear portion of the rear portion of the little finger and the elongated silicone rear portion of the rear portion of the little finger are connected to the non-silicone glove portion along locations on the rear portion of the little finger.

18. The glove of claim 17, wherein the locations of the connection on the rear portion of the little finger of the silicone rear portion of the rear portion of the little finger and the elongated silicone rear portion of the rear portion of the little finger are spaced away from the medial line on the inward lateral side of the little finger.

19. The glove of claim 11, wherein the non-silicone glove portion comprises:

a non-silicone middle finger portion comprising the rear portion of the middle finger, and a non-silicone ring finger portion comprising the rear portion of the ring finger.

20. The glove of claim 19, wherein the non-silicone glove portion further comprises a non-silicone back portion comprising the portion of the back portion not included in the silicone glove portion.

21. A glove comprising:

a thumb;

an index finger;

a middle finger;

a ring finger;

a little finger, each finger having a front portion extending over the front of the finger and a rear portion extending over the rear of the finger, each finger having an outward lateral side with an imaginary medial line extending along the length of the finger and an inward lateral side with an imaginary medial line extending along the length of the finger;

a palm portion;

a back portion, together the palm portion and the back portion define a glove main body, the glove main body having an outward lateral side with an imaginary medial line extending along the length of the outward lateral side of the glove main body and an inward lateral side with an imaginary medial line extending along the length of the inward lateral side of the glove main body, the fingers projecting outward from the palm and back portions, the front portion of each of the fingers being on the same side as the palm portion, and the rear portion of each of the fingers being on the same side as the back portion;

the glove having a silicone glove portion at least partially made from a silicone material and a non-silicone glove portion made from a non-silicone material, the silicone glove portion having:

a silicone thumb portion comprising:

a silicone front portion of the front portion of the thumb, a silicone rear portion of the rear portion of the thumb located toward a free end of the thumb and extending laterally outward from the medial line on the inward lateral side of the thumb toward the medial line on the outward lateral side of the thumb sufficiently to wrap around the inward lateral side of the thumb, and an elongated silicone rear portion of the rear portion of the thumb extending along the medial line on the inward lateral side of the thumb, the elongated silicone rear portion of the rear portion of the thumb extending laterally outward from the medial line on the inward lateral side of the thumb toward the medial line on the outward lateral side of the thumb sufficiently to wrap around the inward lateral side of the thumb;

a silicone index finger portion comprising:

a silicone front portion of the front portion of the index finger, a silicone rear portion of the rear portion of the index finger located toward a free end of the index finger and extending laterally inward from the medial line on the outward lateral side of the index finger toward the medial line on the inward lateral side of the index finger sufficiently to wrap around the outward lateral side of the index finger, and an elongated silicone rear portion of the rear portion of the index finger extending along the medial line on the outward lateral side of the index finger, the elongated silicone rear portion of the rear portion of the index finger extending laterally inward from the medial line on the outward lateral side of the index finger toward the medial line on the inward lateral side of the index finger sufficiently to wrap around the outward lateral side of the index finger;

a silicone little finger portion comprising:

a silicone front portion of the front portion of the little finger, a silicone rear portion of the rear portion of the little finger located toward a free end of the little finger and extending laterally outward from the medial line on the inward lateral side of the little finger toward the medial line on the outward lateral side of the little finger sufficiently to wrap around the inward lateral side of the little finger, and an elongated silicone rear portion of the rear portion of the little finger extending along the medial line on the inward lateral side of the little finger, the elongated silicone rear portion of the rear portion of the little finger extending laterally outward from the medial line on the inward lateral side of the little finger toward the medial line on the outward lateral side of the little finger sufficiently to wrap around the inward lateral side of the little finger;

a silicone palm portion; and an elongated silicone rear portion of the back portion extending along the medial line on the inward lateral side of the glove main body between the elongated silicone rear portion of the rear portion of the little finger and toward an open end portion of the glove, the elongated silicone rear portion of the back portion extending laterally outward from the medial line on the inward lateral side of the glove main body toward the medial line on the outward lateral side of the glove main body sufficiently to wrap around the inward lateral side of the glove main body.

* * * * *